United States Patent [19]

Willits et al.

[11] Patent Number: 4,958,824

[45] Date of Patent: Sep. 25, 1990

[54] AUTOMATIC STRIP AND SHEET LOADER SYSTEM

[75] Inventors: Samuel P. Willits, Barrington; Samuel Meiri, Skokie; Jon C. Muckerheide, Arlington Heights, all of Ill.

[73] Assignee: Spartanics, Ltd., Rolling Meadows, Ill.

[21] Appl. No.: 269,777

[22] Filed: Nov. 9, 1988

[51] Int. Cl.[5] ..... B65H 3/08

[52] U.S. Cl. ..... 271/11; 271/20; 271/91; 271/103; 271/106

[58] Field of Search ..... 271/11, 91–93, 271/103, 104, 106, 112, 20, 18.3

[56] References Cited

U.S. PATENT DOCUMENTS

| | | | |
|---|---|---|---|
| 1,391,271 | 9/1921 | Payne | 271/106 |
| 1,768,586 | 7/1930 | Farley | 271/106 |
| 2,912,240 | 3/1955 | Frankle | 271/106 |
| 3,724,687 | 4/1973 | Marschke | 271/11 X |
| 3,826,485 | 7/1974 | Shindo | 271/106 |
| 3,901,150 | 2/1975 | Vits | 271/103 |
| 3,934,916 | 1/1976 | Baker | 294/64 R |
| 3,938,800 | 2/1976 | Wirz | 271/93 |
| 3,980,293 | 9/1976 | Shelmire | 271/93 |
| 3,997,153 | 12/1976 | Britt | 271/93 |
| 4,106,765 | 8/1978 | Britt | 271/93 |
| 4,444,383 | 4/1984 | Crislip | 271/14 |
| 4,513,957 | 4/1985 | Schaefer | 271/11 X |
| 4,516,762 | 5/1985 | Moltrasio | 271/18.3 X |
| 4,589,648 | 5/1986 | Hancock | 271/106 |
| 4,703,925 | 11/1987 | Jelinek | 271/106 X |

FOREIGN PATENT DOCUMENTS

| | | | |
|---|---|---|---|
| 197334 | 9/1986 | Japan | 271/103 |

*Primary Examiner*—Richard A. Schacher
*Attorney, Agent, or Firm*—Jacque L. Meister

[57] ABSTRACT

A sheet feeding system for feeding single sheets from a magazine containing plural sheets arranged in a stack. A vacuum type sheet pick-up mechanism picks up and deforms one end of the top most sheet to facilitate that sheets separation from the stack. Static and movable separators then act on the top most sheet to complete its separation from the stack and elevate the leading edge to bring it into contact with a friction drive mechanism. The friction drive mechanism is then activated by an external device to cause the sheet to be driven from the magazine. A programmed logic control system sequentially controls the cycling of the mechanism.

20 Claims, 14 Drawing Sheets

AUTOMATIC STRIP AND SHEET LOADER SYSTEM

BACKGROUND OF THE INVENTION

The invention relates generally to sheet feeding apparatus and more particularly to improvements in the sheet lifting, sheet separation and feeding, and control systems for implementing the lifting, separation and feeding Sheet feeding devices are old in the art and many of the earliest are concerned with the feeding of single sheets of paper from a pile or stack and were conceived as adjuncts for printing presses or other printing related operations. Many of the these prior art devices employed one or more vacuum pickups for lifting and separating the top most sheet from the pile. Amongst these are the U.S. patent of Payne, et al, U.S. Pat. No. 1,391,271 which employs a vacuum bar to lift up the rear of the top most sheet and an endless conveyor to complete the lifting of the sheet and move the lifted sheet to either feed rolls or a machine table.

While many of the prior art devices performed well enough for their intended use; they have failed to perform adequately when the individual sheets of the pile adhere to one another or the sheets are relatively stiff such as metal sheets The condition where the sheets adhere to each other is frequently encountered, especially with metallic or plastic sheets and laminated sheets. The adhesion may be due to any of a number of factors including static electricity, cohesion, vacuum, liquid film adhesion, adhesives and surface tension. Further, the relative inflexibility of metallic, plastic or laminated sheets renders most, if not all of the systems intended for paper and similar materials, inoperable.

There is an especially great need for sheet or strip feeding in contemporary automated machine systems which automatically and accurately position sheets or strips in a machining area for repetitive punching, stamping, component mounting, etc., operations. One such system is described in the co-pending U.S Patent Application of Samuel P. Willits, et al, Ser. No 6/920587, assigned to the same assignee as this Application. Such systems literally "eat-up" strips of material and their use would be considerably less advantageous if they could not be regularly and rapidly resupplied with sheets or strips.

As set forth above, prior art sheet feeding devices have proven either unreliable or inoperative when faced with stiff plastic, metallic or laminated sheets and particularly so when the sheets adhere to each other. While prior art devices have attacked these problems, none have overcome these problems in a single device and provided an adaptable sheet feeding system or device for feeding automated contemporary manufacturing process equipment.

SUMMARY OF THE INVENTION

It is a principal object of the invention to provide a new and improved automatic loading system for stacked sheet or strip materials.

Another object of the invention is to provide a new and improved automatic loading system for delivering single sheets or strips from a stack of like material to the receiving mechanism of associated processing machinery.

Still another object is to provide a new and improved automatic loading system for delivering a single sheet or strip from a stack of like materials where there is substantial adhesion between adjacent sheets.

Another object is to provide a new and improved automatic sheet loading system having means to separate stacked sheets that are adhering to each other and on command, delivering single ones of the separated sheets or strips to the receiving mechanism of an associated processing machine.

A further object of the invention is to provide a new and improved automatic sheet loading system having programmable control means to enable and facilitate changes and adjustments in machine operating parameters to correspond with different characteristics in the stacked sheets or strips.

A still further object is to provide a new and improved automatic sheet loading system adaptable to work with various associated sheet or strip feeding mechanisms.

The foregoing and other objects of the invention are achieved by the inventive loading system which provides a magazine into which stacked sheets or strips may be loaded. A vacuum type sheet pick-up mechanism picks up one end of the top most of the sheets in the stack and is cooperatively associated with a sheet separator functioning as a part of the drive mechanism, all cooperatively associated by a programmed logic control system. The nature of the invention and it's several features and objects will more readily be apparent from the following description of certain preferred embodiments thereof taken in conjunction with the accompanying drawings.

DESCRIPTION OF THE PREFERRED EMBODIMENTS

Figure 1:
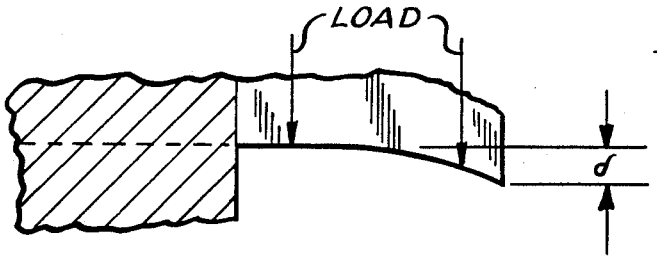
FIG. 1 illustrates the bending of a cantilever beam under random loading.

The technique used in the invention for separating one end or corner of a sheet or strip is based on physical laws. More specifically, beam theory in mechanics establish the relationships between beam geometry, modulus of elasticity, load, stresses and deflections as shown in FIG. 1. In particular:

(1) A certain load will cause specific deflections at points along the beam.

(2) When a loaded beam is in equilibrium, the load is supported by opposing internal reaction stresses.

(3) A loaded beam will return to its initial, normally straight, geometry once the external load is removed, provided the elastic limit of the material has not been exceeded.

Figure 2:
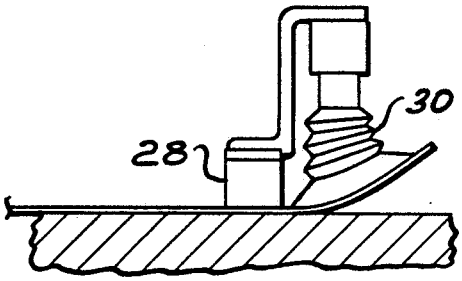
FIG. 2 shows a bent strip of material to be an inverted loaded cantilever beam.

Considering the end of a bent sheet or strip to be a cantilever beam under load where the load is represented by a contracted vacuum bellows, the fixed end condition is represented by a holddown pad 28 as shown in FIG. 2. If only the uppermost sheet or strip in a stack of sheets or strips is held at a curved geometry by the vacuum bellows and if the sum of the gravity and the elastic reaction forces acting in any unsupported sheet or strip is greater than the adhesion force between any two strips, the free strips will stay (or return to) straight, thereby causing separation from the restrained curved outermost strip.

Figure 3:
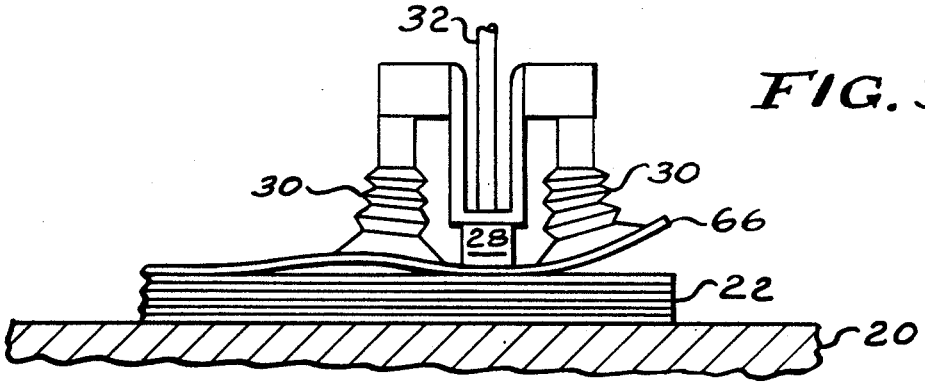
FIG. 3 shows the deformation in a strip of material when acted upon by two vacuum bellows and a bar placed between the bellows and transverse the strip.

In FIG. 3, a second set of vacuum bellows on the other side of the holddown pad 28 is shown to keep the outermost strip bent to a minimum radius when the whole assembly moves away from the stack, thus insuring continued separation.

Referring to FIGS. 4–11, in the preferred embodiment a magazine 20 supports a stack of sheets or strips 22, a pickup head carrier 24 and other system elements. The carrier mounted pick-up head 26 comprises holddown pad assembly 28 and one or more paired sets of vacuum bellows type suction cups 30 mounted on an actuator 32 whose stroke is principally perpendicular to the plane of the stacked strips. The holddown pad assembly 28 comprises a rigid holddown support 34 positioned transverse the strip with an elastomeric material cushion 36 attached to it. The long wearing solid or foam elastomer material reduces the impact on contact with the individual strips of stack 22 and also prevents scratching, deforming or smudging of printing on the strip. Elastomeric rings 38 such as O-rings, or other cushioning means, are provided to reduce impact at the other end of travel of the actuator. Although not illustrated, a conventional proximity sensor, such as a vacuum sensor or a proximity switch, can be used to control the motion of the pick-up head as it is approaching the stack so that the head stops with minimal or no impact. Such deceleration is necessary where adjacent strips tend to increase their adhesion when impacted repeatedly.

Any means of linear or other actuator motion can be utilized to raise and lower pick-up head 26. In the preferred embodiment, an air cylinder actuator 32 was selected because of simplicity, availiability and ease of both operation and control. While the air cylinder actuator provides the required force, a pair of slide guides 40 secured to carriage 24 and extending through bushings on head 26 provide guidance to the cylinder rod of actuator 32 as it extends and retracts. Guides 40 thus prevent rotation of the pickup head 26 about the axis of actuator 32. Care must be taken so that the slide guides 40 do not cause binding of the air cylinder actuator rod, either because of misalignment or because of external side forces. Pick-up means other than vacuum bellows may be employed, e.g., adhesive tape, vacuum cups or pads, direct venturi induced vacuum and gas or liquid jets.

The pick-up head carrier 24 and with it pick-up head 26 can be positioned along the long dimension of strip magazine 20 as indicated by double arrow 42 as well as for transverse movement in the direction of double arrow 44 along the short dimension so that different lengths and widths of strips can be handled as described hereinafter. For convenience in the following discussion, the left arrow on arrow 42 will be designated as pointing in the "forward" direction and the right portion of the arrow as the "home" or "back" direction. Similarly the top of arrow 44 is designated as pointing "in" and the bottom of the arrow as pointing "out".

In the preferred embodiment we shall refer to the stacked sheets or strips 22 where individual strips are separated and delivered from the top of the stack. Other configurations are possible, i.e. bottom or side pick-up utilizing the same concept as will become apparent from the following descriptions of the inventive loader system.

The magazine 20 is comprised of a base 46 whose width can be extended, a back wall 48 whose height determines the maximum height of a stack of strips and an end or forward wall 50. Base 46 supports the stacked sheets or strips and back wall 48 and end wall 50 serve to align the stacked strips as well as provide convenient mounting points for system components as described further hereinbelow. A longitudinal slot 52 is provided in the outside of the magazine back wall 48 as a track in which a movable supporting block 54 for the pick-up head carrier 24 is retained and can be positioned longitudinally. A locking handle 56 will lock the block 54 and carrier in the selected position. A similar arrangement provides the transverse positioning of the pickup head carrier 24 where a track 58 is mounted on carrier support 59 which is, in turn, affixed to support block 54 with handle 60 locking it in position. Thus, X-Y positioning is available for locating the pick-up head relative to the stacked strips. The top of end wall 50 contains a number of spaced apart rollers 62 that support the strip with minimal friction as it is ejected from the magazine. As is described further hereinafter, the rollers 62 also function as a component of an exit gate.

A stack consisting of sheets or strips 22 is placed in the magazine. The pick-up head is driven down, holding the top sheet or strip down near its rear outermost end. Bellows type suction cups 30 are in contact with the strip's end close to the edge and vacuum is applied. The bellows type suction cups 30 then contract and the end or the corner of the top strip 66 is bent up and held in that position a sufficient time to allow the strip(s) below to peel back under the influence of elastic restoring forces and the force of gravity, as previously described. As the pick-up head is raised, the vacuum bellows 30 on the other side of the holddown pad 28 maintains the stress level in the strip. After the pickup head 26 reaches the top of its travel, roller carriage separator 68 is advanced forward between the raised strip 66 and the rest of the stack to complete the separation along the length of the strip 66.

The separator 68 comprises a light weight frame 70 riding on a track 72, which is supported by standoffs 74 from the magazine backwall 48. Separator 68 is guided along the track 72 by grooved rollers 76 affixed to the separator frame.

Separator frame 70 carries a cantilevered roller shaft 78 and a plurality of spaced apart rollers 80 on that shaft. Two additional cantilevered drive roller support shafts 82 and 84 are secured in holes 96 at the front end of separator 68 and utilized as axles for drive support idler rollers 86 that support the strip 66 as it is driven and ejected from the magazine, as described below.

The separator 68 is driven along the magazine between home and forward positions by a motor 88 and a drive cable 90. The drive cable is supported on motor drive roller 92 and idler wheel 94. The drive cable has a combination free travel-spring feature (See FIG. 9) which introduces hysteresis into its connection to the separator frame and thus enables the motor to attain synchronous speed at starting in both directions and helps overcome the inertia load of the system. This is achieved by allowing a limited degree of freedom to fastener block 98 and by connecting cable 90 to fastener block 98 with springs 100.

The cantilevered separator roller shafts 82 and 84 can be mounted in selectable positions on the separator frame 70 by varying their location in holes 96 which are arranged along the frame both horizontally and vertically. This allows the exiting strip 66 to be directed horizontally or slightly upwards towards the exit gate 64 and an upper strip guide 102 mounted on the back wall 48 and extending above end wall 50. Upper strip guide 102 is adjustable in height above strip 66 and carries spaced apart exit gate control rollers 104 aligned above rollers 62 on forward wall 50 with the space between rollers 62 and 104 therefore being adjustable and the two sets of rollers together forming exit gate 64.

At the extreme forward end of the separator stroke the two forward drive roller support shafts 82 and 84 with rollers 86 raise the strip 66 into contact with a floating friction strip drive assembly 106, which can be mounted in a selectable position along the back wall 48. A separator carriage stop 108 stops the separator carriage 68 in the appropriate position under the floating strip drive 106. The stop 108 is attached to the motor drive mount 110 so it need not be repositioned each time the strip drive assembly 106 is moved.

The friction strip drive is comprised of a motor 112 mounted on a swing plate 114, a friction clutch 116, a drive wheel 118 coated with durable high friction elastic material, a load relief adjustable spring 120 and a stop 122. These features are required for adjusting the driving force, which is exerted on the strip 66, the transmitted torque and the no-contact elevation of the drive wheel 118 so that different types of strips can be handled. Obviously, the vacuum at the pickup head 26 must be released before the strip 66 is advanced.

A plurality of guides provide the necessary guidance for the strip as it is handled in the machine. One or more back edge guides 124 can be mounted on the back wall 48 or pick-up carrier support 59. A forward front edge guide 126 is adjustably mounted on the base extension 132 in close proximity to the exit gate 64. Additionally one or more front edge guides 128 are mounted on base support extension 132 spaced apart from guide 126. Front edge guide 128 is mounted on an adjustable friction hinge 130 so that it can be easily flipped between upright as shown and flat against the base extension 132, allowing wide open access to magazine 20 for placing strips 22 in the magazine. It can be positioned anywhere between 0°–90° to suit the stack height. Another rear edge guide 134 mounts on the same main support block 54 that supports the pick-up head 26. It provides guidance to the rear end of the stacked strips 22. This rear edge guide 134 can be positioned longitudinally relative to the pick-up head 26. This allows the operator to select the distance between the rear edge of the strips 22 and the rear edge of the vacuum bellows on pick-up head 26.

The friction drive 106 is activated following receipt of a demand control signal sometimes hereinafter designated as an "ok to load" signal, from the associated processing machinery. The strip 66 exits between the rollers 62 and 104 that form the gate 64 in the end wall 50 and is delivered to the receiving mechanism of the associated processing machinery. The separator 68 then returns to the home position and the cycle repeats with a down stroke of the vertical actuator 32 and associated pick-up head to pick up the next top-most strip of stack 22.

As described above, an exit gate 64 is located at the front or forward end of the magazine. It is formed by the two sets of rollers 62 and 104 and is adjustable in width. In practice, gate 64 is set to slightly more than the material thickness of the individual strips of stack 22. In the rare event of more than one strip being picked up and separated, a forward advance of the strips beyond the gate is then prevented by physical interference. If this should happen, a fault indication is generated as is described further hereafter in connection with FIG. 13.

For long runs, a high vertical stack will have an automatic elevator to maintain top strip level at a fixed elevation. For shorter runs a "next stack" can be placed in position after the "main stack" has been loaded, or strips in any number can be added to the main stack in the magazine at any convenient time with or without stopping the operation.

Figure 11:
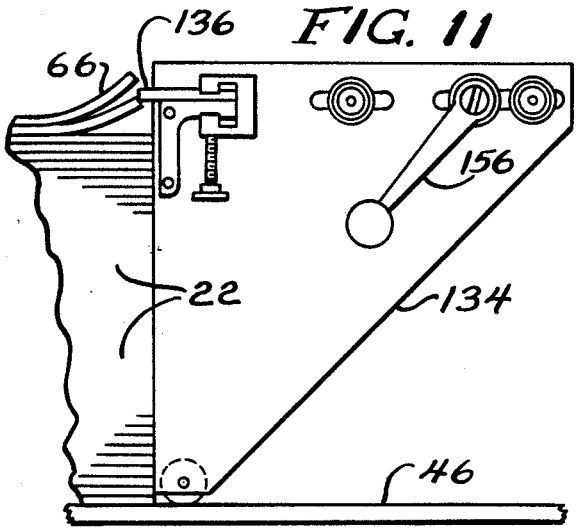
FIG. 11 shows a finger stripper added to the rear end guide of the invention.

For extremely difficult to separate strips such as those with adhesive backing, where the adhesive may ooze along the shear line and make a strong joint between strips, additional separation enhancer means is added to the basic mechanism. Such additional separation means is illustrated in FIG. 11 and comprises one or more fingers 136 adjustably mounted on the forward end of rear end guide 134. These fingers protrude adjustably into the path of the strips as they are lifted. The protrusion is adjusted until fingers 136 just clear the back edge of the topmost deformed strip but contact the back edge of any additional strip that may be adhering to the topmost strip thereby forcing the unsupported strip(s) on the bottom to fall back onto the stack. More than one attempt at strip separation may also be required for the longitudinal travel of separator 68 where such cohesion between strips is encountered and this is automatically then provided as described hereinafter.

Figure 4:
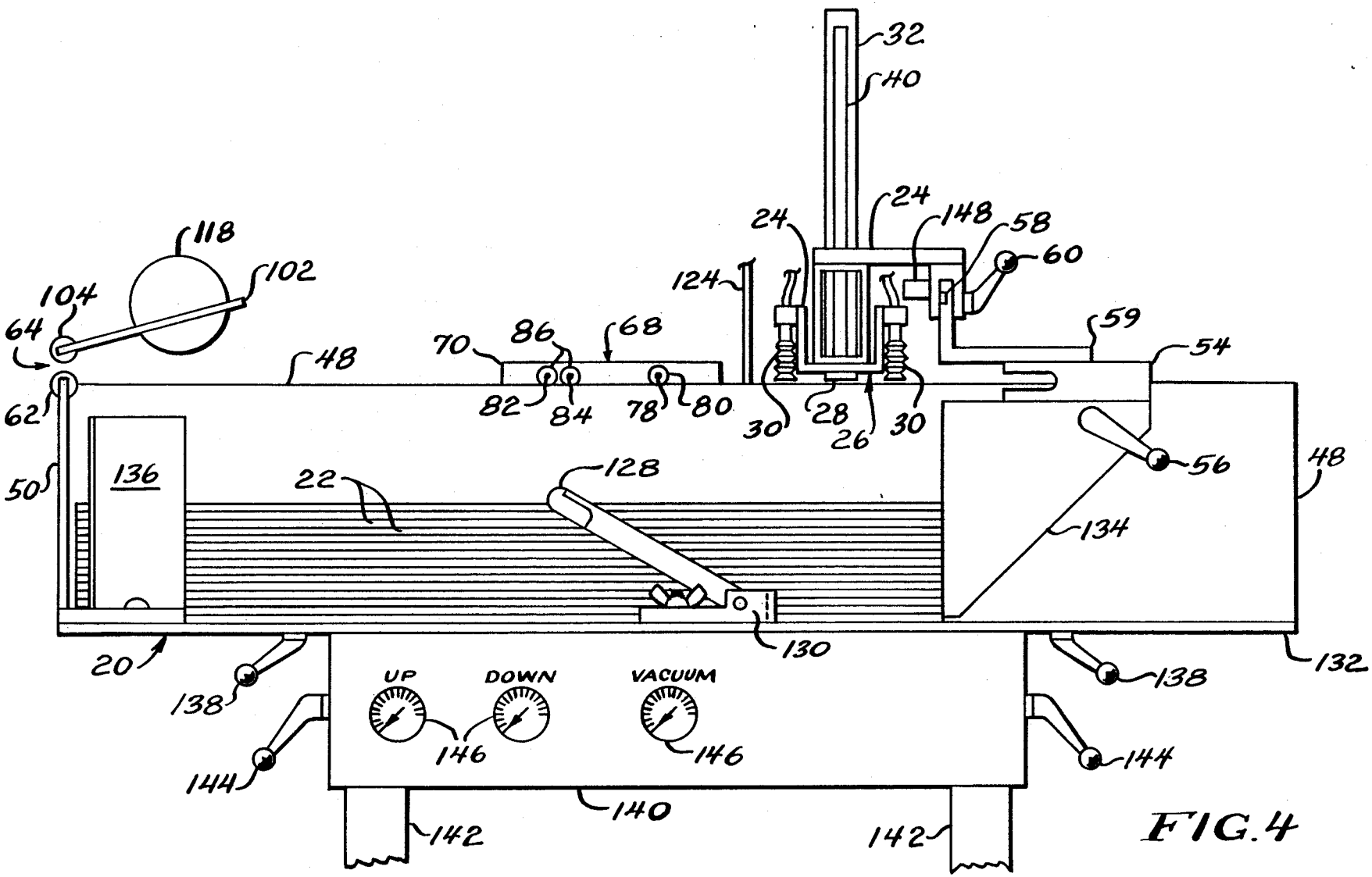
FIG. 4 is a front view of the automatic strip and sheet loader system of the invention.
Figure 5:
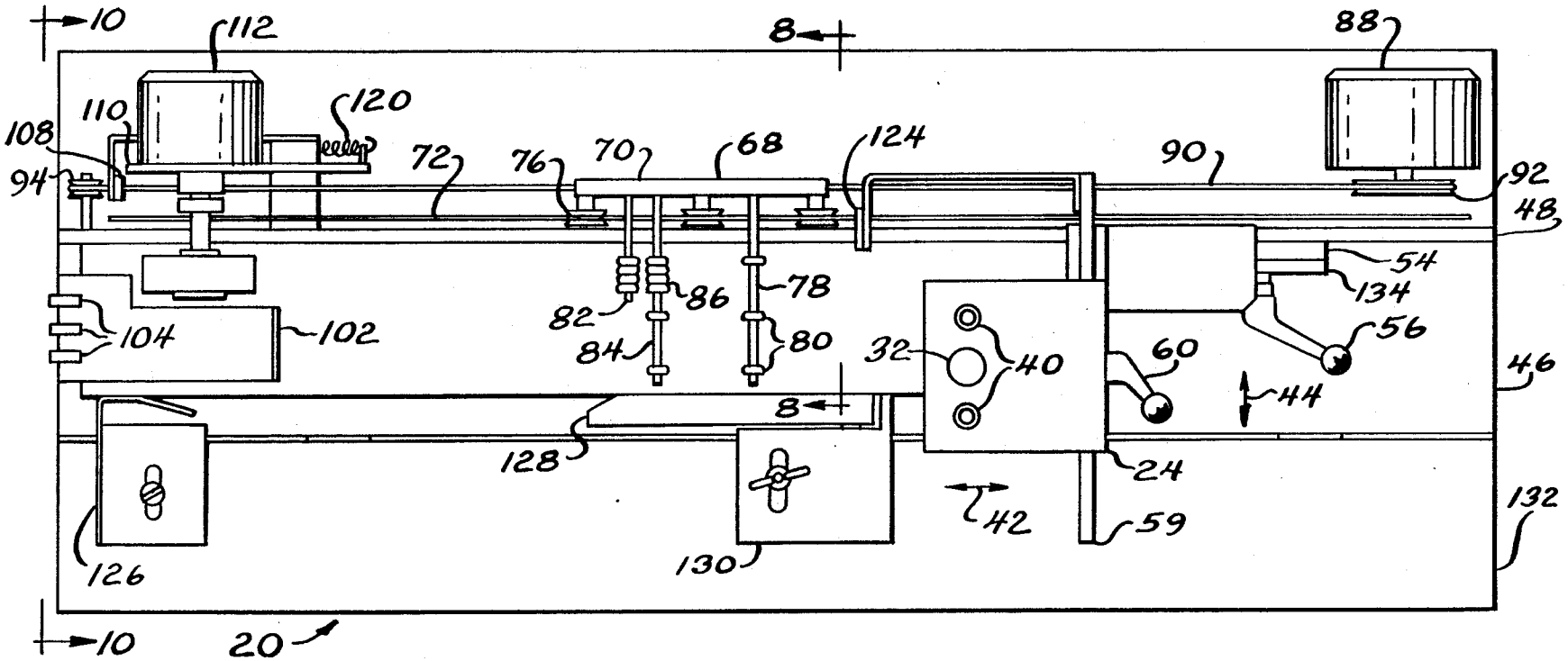
FIG. 5 is a top view of the inventive sheet and strip loader system.
Figure 6:
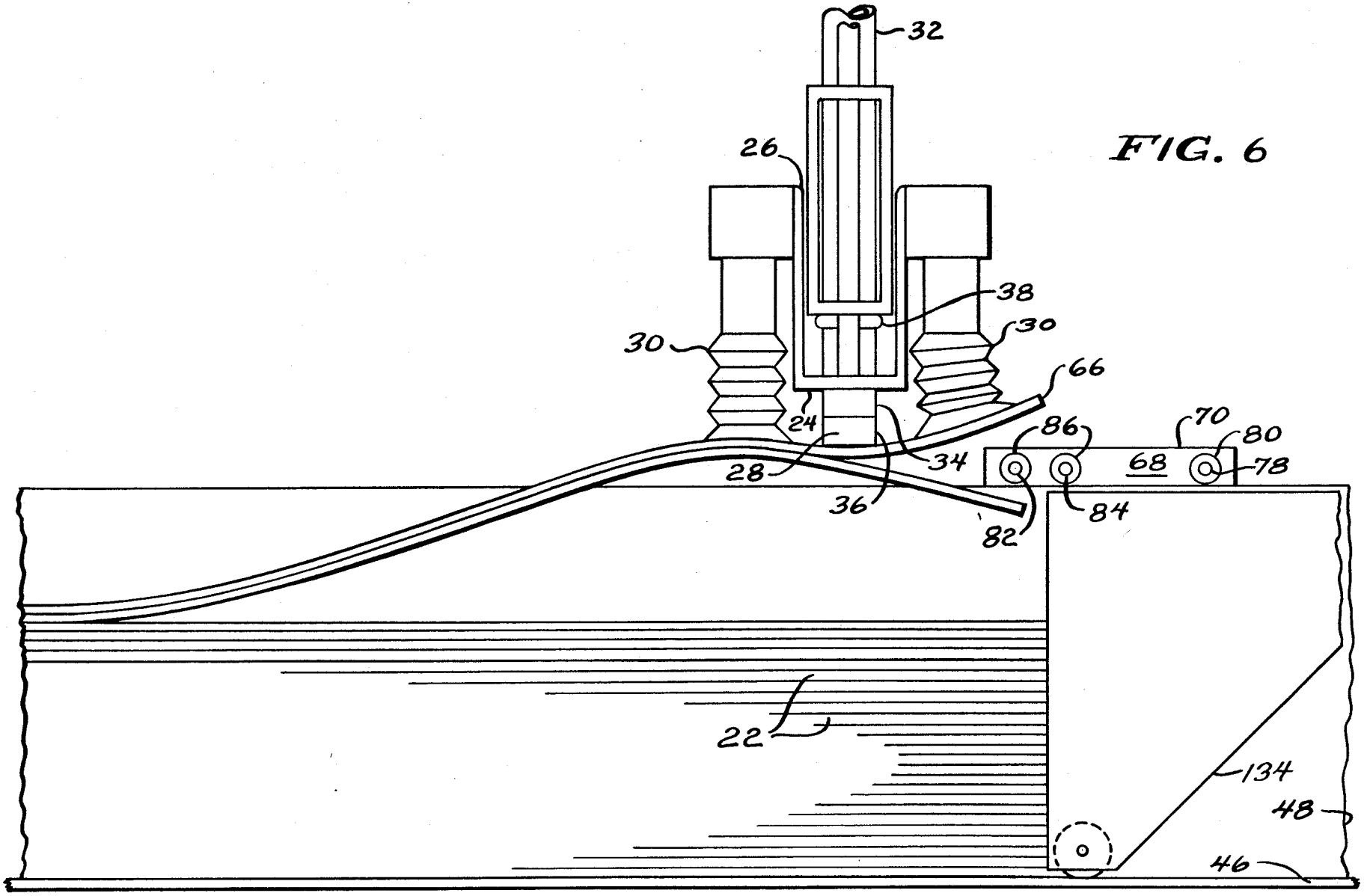
FIG. 6 illustrates the deformation present in a strip when the pickup head carrier of the invention reaches the top of its travel.
Figure 7:
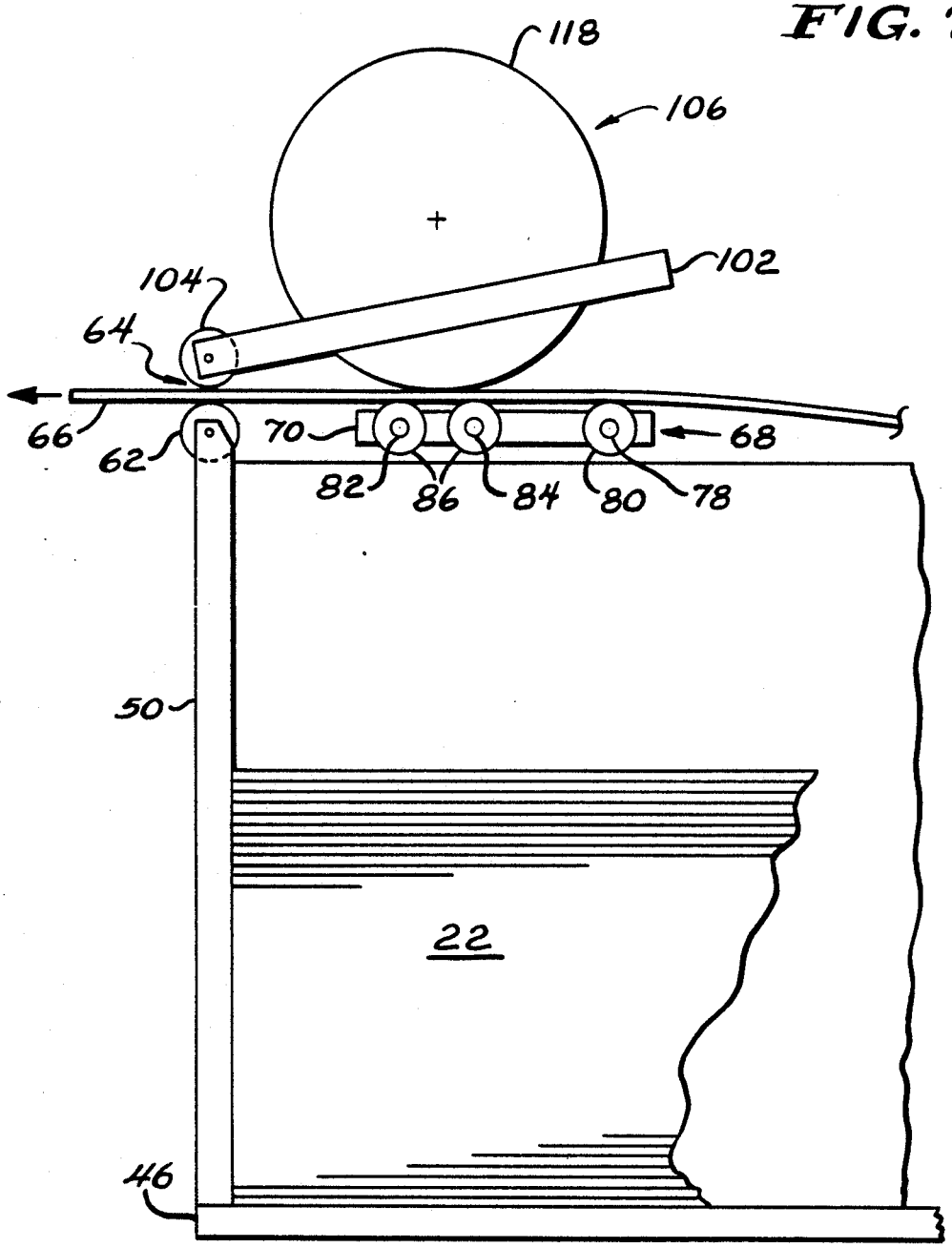
FIG. 7 is a partial front view showing the separator carriage at the extreme forward end of its travel.
Figure 8:
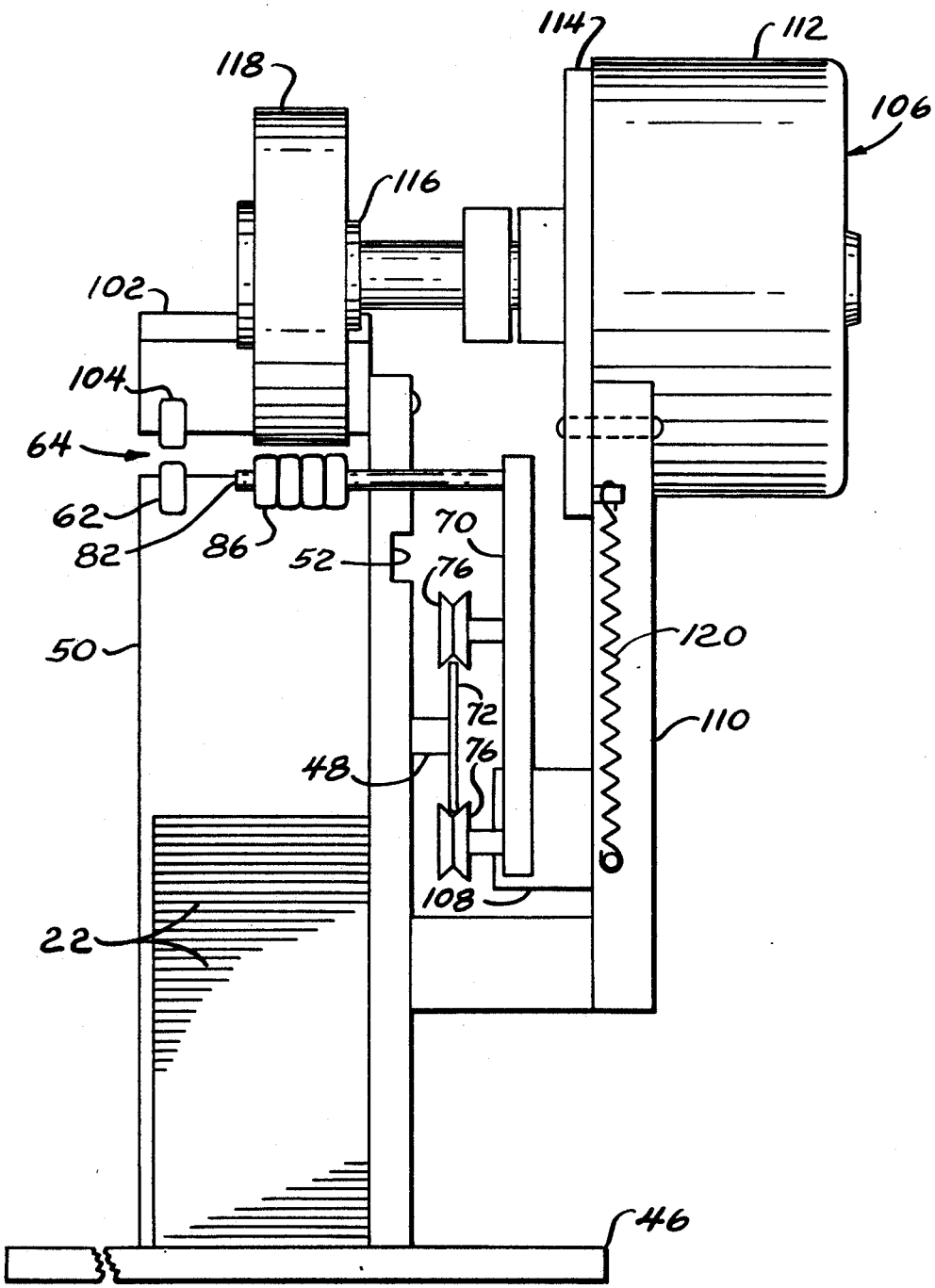
FIG. 8 is a partial section view taken at 8—8 in FIG. 5.
Figure 9:
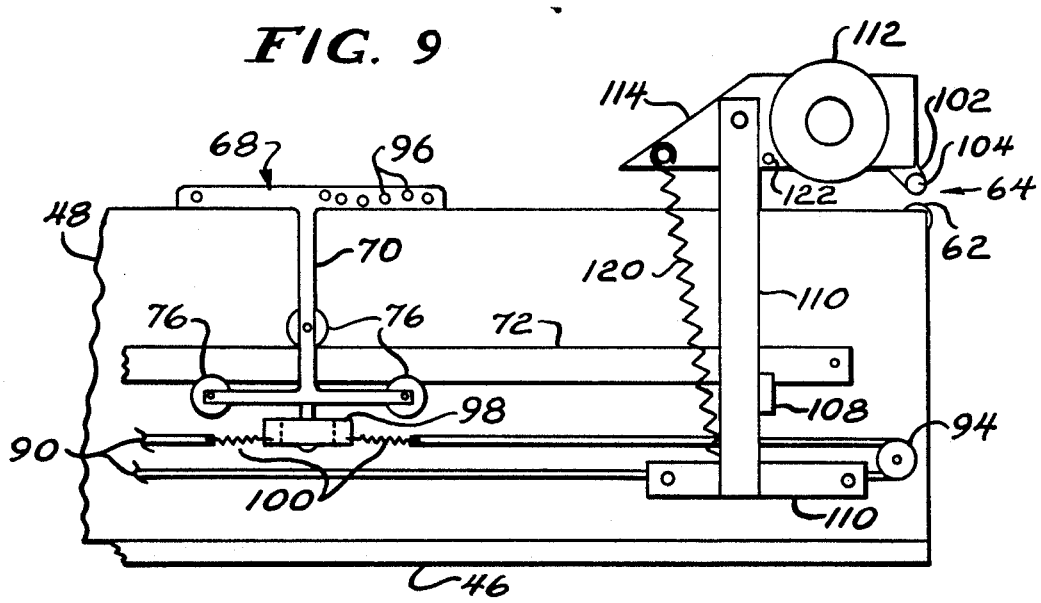
FIG. 9 is a rear view of the separator carriage assembly and strip drive motor.

As best shown in FIGS. 4 and 5, the base of magazine 20 is made adjustable in width to accomodate various widths of sheets or strips 22. A base support extension 132 is adjustably mounted on slides (not shown) affixed to base 46. Extension 132 can be moved in or out relative to base 46 and clamped in place by locking handles 138.

Figure 10:
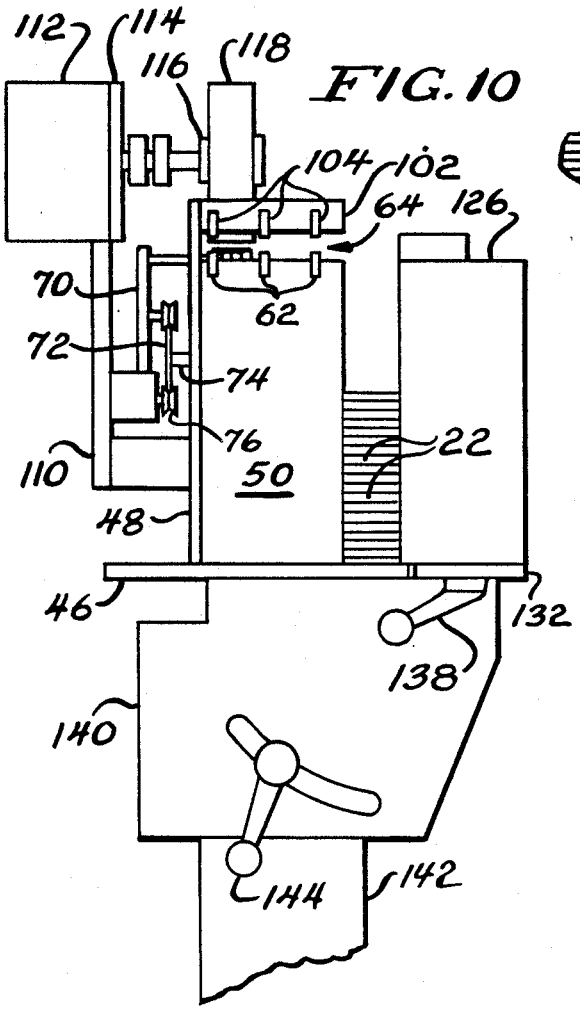
FIG. 10 is a left end view taken at 10—10 in FIG. 5.

A proper alignment of the exiting strip with the receiving mechanism of the processing machinery is crucial for a trouble free operation. To achieve that end, a stand 140 for magazine 20 is provided. Stand 140 (partially shown) is affixed by legs 142 to a wide base (not shown), as required for stability. Rollers (also not shown) are provided for easy alignment and transport on the shop floor. Levelling screws with high wear, high friction pads to insure a fixed aligned position relative to the processing machinery may be provided if desired. The stand is made infinitely adjustable in height by conventional means (not shown) as well as providing fine positioning in an x-y horizontal plane. As shown in FIG. 10, the entire magazine may be inclined up to thirty degrees tilt adjustment, thus allowing for alignment with inclined strip receiving mechanisms, and is clamped in position by locking handles 144. Stand 140 may conveniently be used for the display of pressure gauges 146 for the pneumatic systems employed in the inventive apparatus.

A system control box 150 is provided for operator control and is connected to the system controller described hereinafter by a cable 158. Control box 150 comprises a start button switch 152, a fault indicator 154 and a reset button switch 155 and a Single-Auto selector switch 156.

Control of the various mechanisms of the sheet feeding system is achieved through a combination of sensors and timers utilizing a microcomputer, a programmable controller or a similar, less versatile, sequencing device in combination with commands received from the associated machinery supplied by the sheet feeding system.

Figure 13:
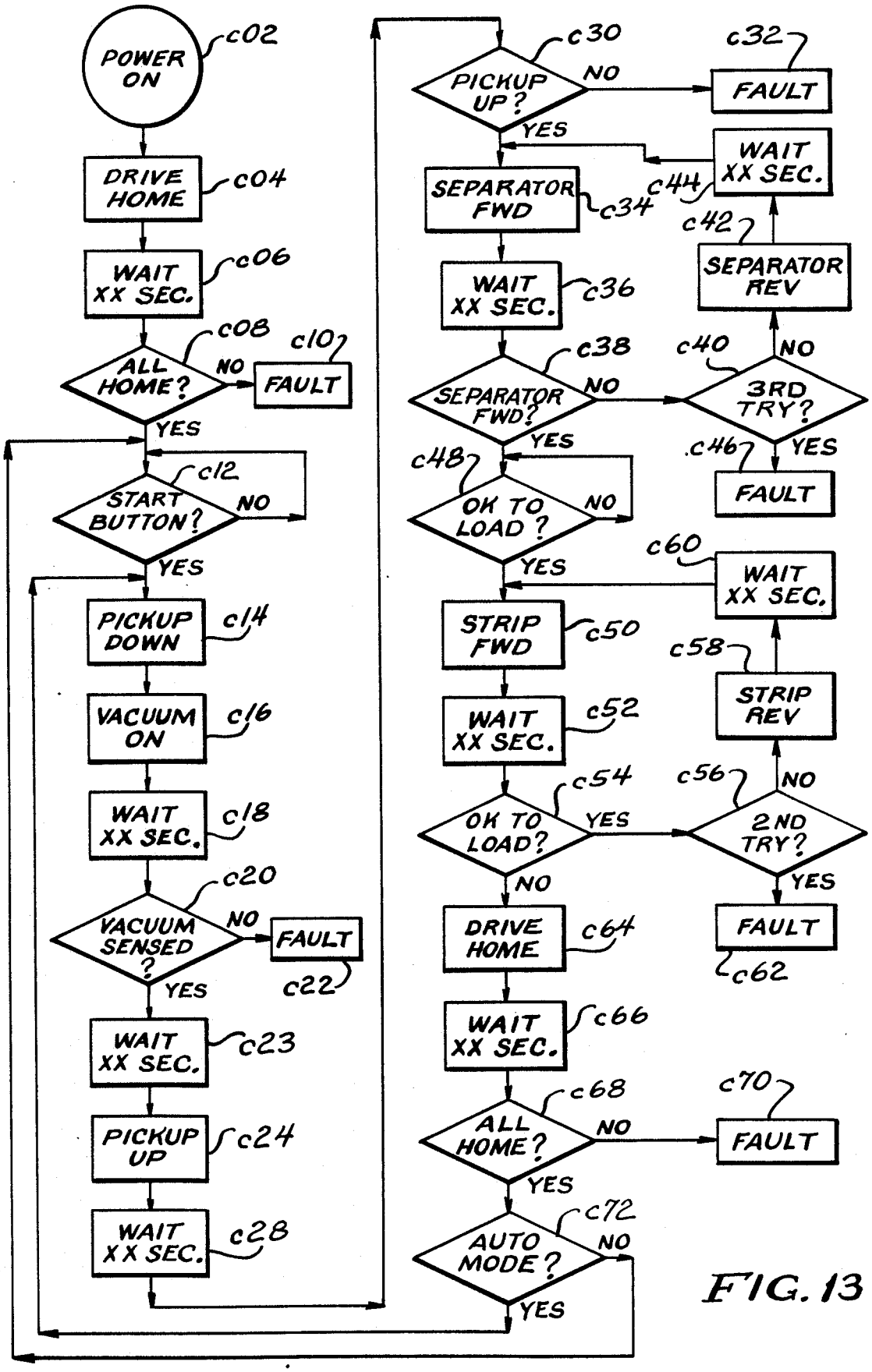
FIG. 13 is a flow chart showing the operation of the invention.

In the preferred embodiment of the invention, system control is achieved through use of a programmable logic controller (PLC) 160. One commercially available PLC advantageously employed in the inventive system is a Texas Instrument, Model T1-128 Controller Sequencer. This device is a microprocessor based system designed to sequentially evaluate the state of numerous program defined conditions at a predetermined frequency of scan determined by an internal oscillator. The PLC, in effect, simulates relay logic and the oscillator maintains synchronous operation of that relay logic as well as the scan frequency. Operation of the control system as carried out in the invention by the PLC 160 is shown in the flow chart of FIG. 13. In FIG. 13, the steps in the flow represent conditions of the PLC at various times and are dependent on its programming and PLC inputs. For convenience in referencing, the various steps and conditions that are represented by blocks in the figure are designated by reference numerals preceded by a "c" to designate "condition".

Figure 12:
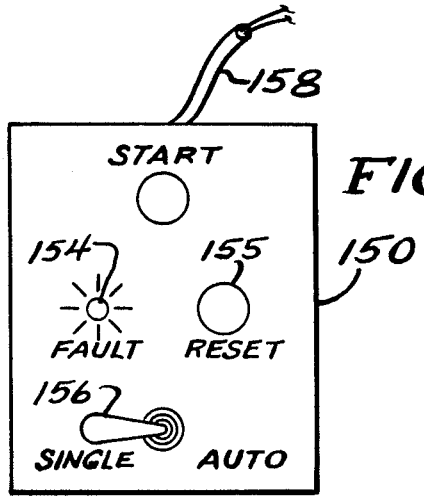
FIG. 12 illustrates the operator control box of the invention.

In operation, the PLC interrogates repeatedly to determine the state or condition of its input signals as supplied from the control box of FIG. 12, the associated receiving machinery, sensor elements on the sheet feeding system of the invention and internally generated signals as follows:

Start signal
Reset signal
Auto-Single switch position
OK to load signal
Vacuum sensor
Up limit sensor
Separator home limit sensor
Separator forward limit sensor
Step switch
Normal test switch
Empty test switch
Pre-load switch Operation is initiated by a power on condition (c2) which causes the pick-up head carrier 24 to move to the up position and the separator 68 is driven to the full home position (c4). This state for the pick-up head and separator is referred to as the home condition. After a predetermined time interval (c6) the state of the mechanism is checked (c8) by interrogating up sensor 148 and a separator home limit sensor (not shown) and a fault condition (c10) is entered if the mechanisms have not reached the home condition.

After the home condition is achieved, the system waits for the start button 152 to be pressed (c12). The pick-up head carrier 24 is then driven down (c14) and vacuum applied to its suction cups 30 (c16). After a predetermined time delay (c18), a vacuum sensor (31) (not shown), is checked to see if vacuum bellows suction cups 30 have contacted the strip of material 22. If vacuum is not sensed (c20) a fault condition (c22) is entered.

If the vacuum has been sensed, the system waits a predetermined time (c23) and then the pick-up head carrier 24 is driven to the up position (c24). After another predetermined time delay (c28), the position of the pick-up head carrier 24 is checked (c30) by up sensor 148 and a fault condition (c32) is entered if the full up position has not been achieved.

After the full up position has been achieved the separator 68 is driven forward (c34). After a predetermined time delay (c36) the separator 68 is checked by a forward limit sensor (not shown) to see if the full forward position has been achieved (c38). If the ful1 forward position is not achieved, the system enters a retry loop. The retry count is checked (c40) and if less than three tries have been attempted the separator 68 is reversed and driven toward the home position (c42) for a fixed time (c44) and then it is again reversed and driven forward (c34). If the separator does not reach the full forward position within three attempts, the fault condition (c46) is entered. The number of attempts is of course predetermined and may be any number, but three is used in the preferred embodiment.

Once the separator 68 has reached the full forward position the loader system waits for an "OK to Load" signal (c48) from the associated strip receiving machinery. When an OK to Load signal is detected, the strip drive motor 112 is turned on (c50) to load the separated top strip 66 into the associated strip receiving machinery. After a predetermined time delay (c52) the OK to Load signal is checked (c54). If the OK to Load signal has not been removed, the system enters a retry loop. The retry count is checked (c56) and if fewer than two tries have been attempted the strip drive motor 112 is reversed (c58) for a short time (c60) and then reversed again (c50) If the strip has not been loaded after two attempts a fault condition (c52) is entered.

After the strip 66 is loaded, the mechanism is driven to again achieve the home condition with pick-up head carrier 24 being driven to the up position and separator 68 driven to the home position Again, as in the power on sequence, after time delay (c66) the mechanism is checked (c68) and a fault condition (c70) is entered if the home condition has not been achieved.

Once the home condition has been reached the state of the Auto/Single switch 156 is checked (c72). If the switch is in the Auto position another strip loading cycle begins without pause. If the switch is in the Single position the system waits for start button 152 to be pressed (c12) before starting another strip loading cycle.

When a fault condition (c10, c22, c32, c46, c62, c70) is entered, all PLC controller outputs are de-energized and fault indicator 154 is illuminated. The operator must press the reset button 155 to restart operation. The reset button forces the sequence to the power on condition (c2). The reset button forces this power on reset any time it is pressed, during normal operation or from a fault condition.

Figure 14:
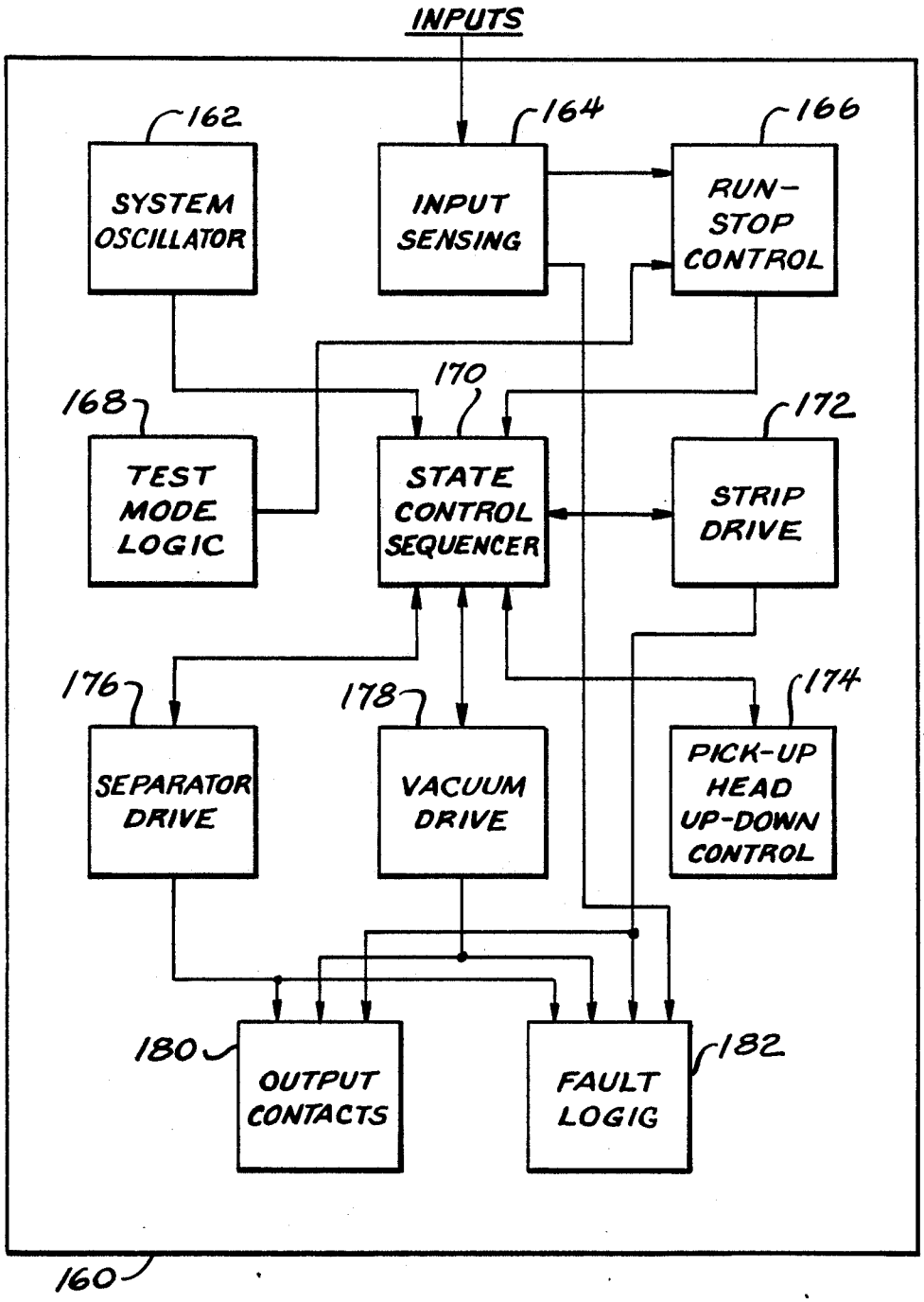
FIG. 14 is a block diagram of the logic sections of the microprocessor used to control the inventive system.

To achieve the operation of the system as shown and described above in connection with FIG. 13, the PLC 160 is programmed with eleven different logic sections as shown in FIG. 14. In the description of FIG. 14 that follows, the description is given as if PLC 160 were comprised of relays with their contacts arranged in conventional ladder logic form. The specific PLC 160 employed in the preferred embodiment is programmed in a language to simulate relay ladder logic and, indeed, such means could be employed, but, as described above, the relays are simulated by the microprocessor of the PLC. The PLC simulates relay ladder logic by sequentially executing each rung of the ladder logic program and energizing or releasing output contacts and internal simulated control relays as directed by the ladder logic program in response to its input signals described above.

The system oscillator section 162 is designed to supply a clock to the rest of the PLC. The clock frequency is one half of the scan or interrogation frequency and is used to maintain synchronous operation of the simulated relay logic.

The input sensing section 164 of the PLC checks the state of the system input lines and fires or releases control relays depending on the state of a particular line. The input sensing is grouped as a section for two reasons; First is program maintenance; the individual contacts could be sensed directly, where required by the logic, but should some future development require that an input contact be redefined, then the logic surrounding each occurrence of that contact would have to be changed. The described logic configuration allows only the input sensing section of the logic to be changed. The second reason is stability; as each input is sensed only once per scan, the state of that input is forced to be stable for an entire scan. If the input state of a particular contact were sensed in several places during a scan, then a number of ambiguous logic states could occur wherein logic at the top of the ladder might respond to a contact open condition while logic at the end of the scan responds to a contact closed condition for the same input.

In the run/stop control section 166, there are 3 rungs with the first set of rungs implementing the run contact which controls the single or repetitive cycling of the machine. If the AUTO contact is open, pressing the start button 152 while the machine is in the home condition will generate a run pulse causing the machine to cycle once. If the auto contact is closed, the run contact will be maintained causing the machine to cycle repeatedly.

The second set of rungs implements the system reset function. A system reset pulse is issued during power on or whenever the reset button is pressed. The pulse is latched so that it is maintained until the reset condition is achieved.

The third set of rungs generates the OK to drive signal This signal indicates to the rest of the logic that:

(1) The limit switches are operating properly.

(2) The pickup head is in the full up position.

This condition is required in order to start either the separator or strip drive motors.

In the test mode logic section 168, there are 4 rungs and the rungs generate a number of signals required for a self test auto cycle and single step modes of operation. The first rungs generate a common test cycle signal. The second set generates a single step pulse for each push of the start button which is extremely useful during system setup. The third and fourth rungs generate test wait times to simulate normal operation while in the test mode.

The state control logic section 170 contains 4 rungs and implements a state control for the machine. The machine may be in any one of six possible states or conditions. Machine state operation as described here is for normal operation. The auto cycle operation will be described later. The machine states or conditions are:

(1) Home: All mechanisms return to their home or neutral positions. In this condition the machine is ready to pick up another strip. This position also allows additional material to be loaded in the machine.

The home state is exited when the mechanisms are in their neutral positions and the start contact is energized.

(2) Down: In this state the pickup head 26 is driven down and the vacuum turned on.

The down state is exited when vacuum is sensed indicating that the material has been contacted.

(3) Lift: In this state the pickup head 26, holding the top strip of material off of the stack, is returned to the up position.

The up state is exited when the pickup head reaches the full up position as signaled by sensor 148.

(4) Separate: In this state the separator 68 is driven to the full forward position to peel the top.

The separate condition is exited when the separator reaches the full forward position as signalled by a limit sensor (not shown).

(5) Load Wait: In this state the machine is waiting for an OK to Load signal from the associated strip receiving machine. The load wait condition is exited when the OK to Load signal is sensed.

(6) Load: In this state the strip drive motor 112 is energized to drive the strip of material forward and load the associated Strip Feed device.

The load condition is exited and the home condition entered when the Ok to Load signal is removed.

The first rung of logic implements a shift register which stores the current state of the machine.

The second rung is a recycle control for the shift register to return the system to the Home state after stepping out of the run state.

The third rung of logic is the step control logic for the shift register. This logic generates a step clock to the shift register when the requirments for advancing to the next state or condition have been met.

The fourth rung of logic generates a de-bounced load signal for the shift register so that glitches on the Ok to Load input will not advance the shift register.

The strip drive section 172 implements the logic for the strip drive motor 112 and comprises 8 rungs.

The first rung generates a drive enable signal for the strip drive motor when the machine is in the proper state.

The second through fifth rungs implement a retry function If the strip is not loaded successfully during the period of the foreward timer, the strip drive motor is stopped momentarily, reversed for a short time, stopped again, and then restarted in the forward direction. This reverse and retry motion will often succeed in loading a strip which has hung up and not loaded properly.

The sixth and seventh rungs generate the forward and reverse drive signals for the strip drive motor 112.

The eighth rung generates a Load Fail signal if a designated number of successive retry attempts fail to load the strip.

The up/down control section 174 comprises 5 rungs utilized to control the up and down drive for the pickup head 26.

The first and third rungs generate the drive signals.

The second rung generates a "down over" signal when the pickup head 26 is down and vacuum is sensed. There is a time delay on this signal to allow time for the vacuum cups 30 on the pickup head to retract and peel up the trailing edge of the strip.

The fourth rung generates an Up Fail signal if the pickup head fails to reach the full up position within some time interval after being driven up. This failure indicates a stuck pickup head.

The fifth rung generates an "Up Over" signal when the pickup head successfully reaches the top of travel The separator drive logic section 176 comprises 8 rungs and parallels the strip drive logic including the retry function and the fail functions. The specific rungs have analogous functions applied to the separator motor.

The vacuum drive section 178 comprises 4 rungs with the first rung generating a vacuum drive signal when the machine is in either the down, lift or separate state The second rung generates a failure signal if vacuum is not sensed after several seconds in the down state. This typically indicates either an empty material hopper or a poorly jogged stack.

The third rung generates a continous vacuum fail signal when the vacuum sensor indicates vacuum while the vacuum drive is off. This indicates a failed or misadjusted vacuum sensor.

The fourth rung generates a combined vacucum failure signal whenever vacuum is not sensed when expected.

The output contact section 180 comprises the 7 contacts utilized for machine actuation; namely, vacuum on, pickup head up, pickup head down, strip drive motor forward, strip drive motor reverse, separator drive motor forward and separator drive motor reverse. The output contacts of section 180 are grouped in the same manner and for the same reason as the input contacts.

The Fault section 182 combines the assorted failure signals to generate a common Fault signal. The Fault contact removes all power from the outputs and latches in. The reset button must be pressed to clear a Fault condition.

It is a feature of the invention that the aforedescribed control system allows 3 different test/setup modes; a Step Mode, a Normal Test Mode and an Empty Test Mode, described as follows:

When the Step switch input is energized, the machine enters a step mode in which all error checking is inhibited and the starter remains in a given state until the Start button is pressed. This mode is most useful during initial setup of the machine when "slow motion" operation can isolate faults and allow adjustments to be made.

When the Normal Test switch input is actuated, the machine enters an auto-cycle mode. In this mode all error sensing is active except the Load Fail sensing. The Load Wait and Load states are exited based on fixed time delays as opposed to signals from the Strip Feed as in normal operation. The Start, Auto/Single, and Reset controls retain their normal function.

When the Empty Test switch input is actuated the machine enters an auto-cycle mode. In this mode all error sensing is inhibited so that the machine may be cycled with no material present in the hopper. The Start, Auto/Single and Reset controls retain their normal function.

From the foregoing description it is can be seen that the invention is well adapted to attain all of the ends and objects set forth together with other advantages which are obvious and inherent to the apparatus taken together with its control system. Further, it should be understood that certain features and subcombinations are useful and may be employed without reference to other features and subcombinations that are also useful and may be employed without reference to such other features and subcombinations. In particular, it should be understood that in the described embodiment of the invention there has been described a particular microprocessor control unit with various peripheral imputs and outputs and a software program but that though described in the manner of particular computer elements and programs, other computer elements and programs and other processing means may be employed to effect a similar result.

The detailed description of the invention herein has been with respect to preferred embodiment thereof. However, it will be understood that variations and modifications can be effected within the spirit and scope of the invention as described hereinabove and as defined in the appended claims.

What is claimed is:

1. A system for successively feeding the topmost sheet of plural stacked sheets on command, comprising magazine means for supporting said plural stacked sheets, said magazine means comprising base means, a back wall and a forward wall, pickup head means adjustably mounted on said magazine means for separating and lifting one end of said topmost sheet from the remaining plural stacked sheets, separator means mounted on said magazine means and movable between a home position and a forward position beneath said topmost sheet to complete the separation of said topmost sheet from the remaining plural stacked sheets and thereby support the forward end of said topmost sheet in a raised position, drive roll means adjustably mounted on said magazine means and contacting said raised forward end of said topmost sheet and responsive to a commanded demand control signal to drive said topmost sheet from said magazine means, and control system means connected to said pickup head means, said separator means and said drive roll means for sequentially effecting their operation in response to demand and start control signals in accord with predetermined instructions and conditions.

2. A sheet feeding system in accord with claim 1 wherein said magazine means further comprises adjustably mounted base support extension means for adjusting the width of said base means and front edge guide means adjustably mounted on said base support extension means to align the sheets comprising said plural stacked sheets.

3. A sheet feeding system in accord with claim 1 wherein said pickup head means further comprises hold down pad means and at least one paired vacuum bellows means disposed with one bellows of each pair on either side of said hold down pad means.

4. A sheet feeding device in accord with claims 1 or 3 wherein said pickup head means further comprises actuator means for moving said pickup head back and forth between up and down positions on command of said control system means.

5. A sheet feeding device in accord with claim 1 wherein said separator means further comprises track means mounted on said magazine means extending between said home position and said forward position, frame means supported for movement along said track means and separator drive means mounted on said magazine means to enable driving said frame means back and forth between said home and said forward positions on command from said control system means.

6. A sheet feeding system in accord with claim 5 wherein said separator means further comprises plural roller shafts each carrying rollers thereon and secured at their one end to said frame means to extend therefrom over said plural stacked sheets.

7. A sheet feeding system in accord with claim 1 wherein said drive roll means comprises mounting means adjustably secured to said magazine assembly, drive motor means mounted on said mounting means to allow restricted motion with respect thereto and drive wheel means friction clutch coupled to said drive motor means, said drive motor means being activated on command from said control system means.

8. A sheet feeding system in accord with claim 1 wherein said control system means comprises programmable microprocessor means having a plurality of inputs and outputs for sequentially evaluating said inputs to determine compliance with its programmed conditions and thereupon appropriately activate said pickup head means, said separator means and said drive roll means to effect top sheet pickup and separation and to drive said top sheet from said magazine.

9. A sheet feeding system in accord with claim 1 further comprising exit gate means secured to said magazine means at its forward end in the path of exiting sheets.

10. A sheet feeding system in accord with claim 9 wherein said exit gate means comprises plural sheet support roller means disposed on the the forward end of said magazine and in line with exiting sheets, upper sheet guide means adjustably secured to said magazine means at the forward end thereof, and one or more exit gate control roller means disposed on the forward end of said upper sheet guide means spaced apart from said sheet support roller means by a distance slightly greater than the thickness of one of said stacked sheets to thereby prevent plural sheets from exiting said sheet feeding system.

11. A sheet feeding system in accord with claim 1 or 9 further comprising separation enhancer means positioned to interfere with additional sheets being lifted by said pickup head means.

12. A sheet feeding system in accord with claim 1 or 9 further comprising adjustable stand means affixed to and supporting said magazine means, said stand means comprising height adjustment means and tilt adjustment means.

13. A method for feeding single sheets from a stack of similar sheets positioned in the magazine of a sheet feeding mechanism having sheet vacuum pickup means, separator means and sheet drive roll means, comprising the steps of driving said vacuum pickup means into contact with the top surface of the stacked similar sheets near one end thereof, applying vacuum to said vacuum pickup means to effect bending of the topmost of said stacked sheets to effect its separation from lower sheets, raising said pickup means and said topmost sheet to increase sheet separation of said topmost sheet, driving said separator means beneath and along the length of said topmost sheet from the picked up end to the far end thereof and stopping there to support said topmost sheet's far end in contact with said sheet drive roll means, and activating said drive roll means to eject said topmost sheet from said sheet feeding mechanism.

14. A sheet separating system for separating one end of an outside sheet from a stack of sheets and moving the end of said outside sheet away from the remaining stacked sheets comprising:

pickup head means for gripping, bending and moving said outside sheet comprising a holddown pad, one or more primary vacuum bellows movable material grippers between said holddown pad and the end of said outside sheet, one or more secondary vacuum bellows movable material grippers on the opposite side of said holddown pad, actuator means to move said pickup head means in a direction approximately normal to the plane of said stacked sheets, vacuum sensor means for sensing contact of all of said material grippers with said outside sheet and providing an output signal in response thereto, and control system means connected to said pickup head means, said actuator means and said vacuum sensor means to effect operation of said pickup head means and said actuator means in response to predetermined instructions and the output of said vacuum sensor means.

15. A sheet separating system for separating one end of an outside sheet from a stack of sheets and moving the end of said outside sheet away from the remaining stacked sheets comprising:

pickup head means for gripping, bending and moving said outside sheet comprising a holddown pad, one or more primary movable material grippers between said holddown pad and the end of said outside sheet, one or more secondary movable material grippers on the opposite side of said holddown pad, actuator means to move said pickup head means in a direction approximately normal to the plane of said stacked sheets, vacuum sensor means for sensing contact of all of said material grippers with said outside sheet and providing an output signal in response thereto, control system means connected to said pickup head means, said actuator means and said vacuum sensor means to effect operation of said pickup head means and said actuator means in response to predetermined instructions and the output of said vacuum sensor means, and separation enhancer means comprising at least one fixed member arranged to protrude into the path of sheets being raised by said pickup head means by an amount to clear the topmost sheet but positioned to interfere with additional sheets being lifted by said pickup head means.

16. The method for effecting topmost sheet separation from plural stacked sheets disposed in a sheet feeding system and feeding said topmost sheet on command from an associated machine, said sheet feeding system comprising sheet pickup head means including one or more gripper means and sheet holddown means, separator means and sheet drive roll means, the improvement comprising the steps of initiating a return to home signal in response to a power on condition to cause said pickup head means and said separator means to drive to a home position First system condition, initiating a topmost sheet pickup and separation sequence upon receipt of a start signal, said sequence comprising, driving said pickup head means from said home position to a position where said sheet holddown means and said gripper means are in contact with the top surface of said topmost sheet near the home position end thereof, actuating said gripper means to effect bending of said home position end of said topmost sheet to effect a separation condition of said end from the stacked sheets remaining therebelow and effect a Second system condition, driving said pickup head means with said topmost sheet gripped thereby away from said remaining stacked sheets and to said pickup head's home position and effect a Third system condition, and initiating a separator means drive signal to effect movement of said separator means from home position beneath said topmost sheet to a full forward position completing separation of said topmost sheet and supporting said topmost sheet at said full forward position in contact with said sheet drive roll means, and effect a Fourth system condition, initiating a control signal to turn said drive roll means on and said gripper means off upon receipt of a command signal from said associated machine and thereby eject said topmost sheet from said sheet feeding system to said associated machine and thereby achieve a machine clear Fifth system condition, and initiating a return to home signal upon completion of said topmost sheets ejection to cause said separator means to return to a home position Sixth system condition and to turn off said drive roll means.

17. The method for effecting topmost sheet separation and feeding in accord with claim 16 further comprising the steps of verifying each of the aforesaid six system conditions as a prerequisite toward proceeding to the next condition and generating a fault condition whenever anyone of the six system conditions is not achieved.

18. The method of effecting topmost sheet separation and feeding in accord with claim 17 further comprising an additional one or more retry steps following a failure to verify said fourth system condition and prior to generating a fault condition.

19. The method of effecting topmost sheet separation and feeding in accord with claim 17 further comprising an additional one or more retry steps following a failure to verify said fifth system condition and prior to generating a fault condition.

20. The method of effecting topmost sheet separation and feeding in accord with claim 16 further comprising the additional step of verifying the state of an auto/single control switch for said sheet feeding system and commencing a further topmost sheet pickup, separation and feed sequence if said switch is in the auto position and stopping said sheet feeding system until receipt of a further start signal if said switch is in the single position.

* * * * *